US006883495B1

(12) United States Patent
Strauss

(10) Patent No.: US 6,883,495 B1
(45) Date of Patent: Apr. 26, 2005

(54) ADAPTIVE IDLE SPEED CONTROL FOR A DIRECT INJECTED INTERNAL COMBUSTION ENGINE

(75) Inventor: Sebastian Strauss, Pleasant Prairie, WI (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/605,622

(22) Filed: Oct. 14, 2003

(51) Int. Cl.[7] ..... F02M 3/00
(52) U.S. Cl. ..... 123/339.1; 440/1
(58) Field of Search ..... 123/339.1, 339.14; 701/103, 110; 290/40 A, 40 C, 40 F; 320/132; 440/1

(56) References Cited

U.S. PATENT DOCUMENTS 5,293,076 A * 3/1994 Fukui ..... 290/40 C
5,685,802 A * 11/1997 Kanno ..... 477/111
5,998,881 A * 12/1999 Wind et al. ..... 290/40 A
6,404,163 B1 * 6/2002 Kapsokavathis et al. .... 320/104
6,573,614 B1 * 6/2003 Doll ..... 290/40 C
6,652,330 B1 * 11/2003 Wasilewski ..... 440/1
2003/0076071 A1 * 4/2003 Kanno ..... 320/132

* cited by examiner

*Primary Examiner*—Hai Huynh
(74) *Attorney, Agent, or Firm*—BRP Legal Services

(57) ABSTRACT

The present invention provides a system and method of adaptively setting the idle speed of an internal combustion engine based on instantaneous power requirements of the engine. By adaptively setting engine idle speed based on instantaneous power requirements of the engine as well as the power requirements of any auxiliary devices, the noise and exhaust emissions of the engine may be reduced as well as improving fuel consumption efficiency. The engine's electronic control unit (ECU) is designed to regulate an idle speed controller based on current feedback received from sensors operationally connected to the engine as well as the various auxiliary devices. The ECU regulates the idle speed control such that the engine electronics are sufficiently energized to run the engine, but the engine idle speed is also set to a level that takes into account the instantaneous power requirements of the various system components and/or devices.

21 Claims, 3 Drawing Sheets

ADAPTIVE IDLE SPEED CONTROL FOR A DIRECT INJECTED INTERNAL COMBUSTION ENGINE

BACKGROUND OF INVENTION

The present invention relates generally to engine speed control and, more particularly, to a method and system of adaptively regulating the idle speed of an engine based on instantaneous power requirements of an outboard motor.

Generally, the alternator or battery charging device of a motor is belt or gear driven by the crankshaft of an internal combustion engine. As such, the charging characteristics of the alternator are at least influenced by the speed of the engine. As is well known, the alternator charges a battery which is used to supply power to various electronics and auxiliary power devices in the motor as well as the system or apparatus driven by the engine, such as a boat, personal watercraft (PWC), snowmobile, all terrain vehicle (ATV), and the like. Since the engine electronics, as well as system electronics, must also be sufficiently powered when the engine is at idle, most motors include an idle speed control that sets a minimum idle speed of the engine. Typically, the idle speed is set to a level sufficient to drive the alternator such that a sufficient amount of power is provided to the engine electronics and system electronics, or auxiliary devices powered by the battery, at all possible idle conditions. Because the idle speed is set to a value that provides sufficient current supply under all conditions, the idle speed may, under certain conditions, exceed that which is actually necessary to maintain an acceptable idle condition of the engine.

Similar to an engine running at a non-idle speed, an engine running at idle continues to emit noise, consume fuel, and emit exhaust. As such, the greater the idle speed, the more noise the engine generates, the more exhaust that is emitted to the atmosphere, and the more fuel that is consumed. Accordingly, it is clearly desirable to optimize the engine's idle speed.

An optimized idle speed, a reduced idle speed results in a reduction of noise, exhaust emissions, as well as fuel consumption. Additionally, in the example of an outboard motor, reducing the engine idle speed to an optimal level allows the boat to operate at lower speeds, which would also make trolling with larger engines possible and improve trolling capabilities of mid-size engines. However, since the idle speed limit of the engine is chiefly governed by the current output of the alternator or battery charging device, the idle speed must be set to a level to provide sufficient current for the engine control unit, driving of the fuel injectors, battery charging, and operation of auxiliary devices, such as lights, live well aerators, bilge pumps, and the like even when the engine is at idle. However, idle speed controls of known motors do not include feedback and therefore have fixed idle speeds that fail to consider the instantaneous power requirements of the battery, engine electronics, and the auxiliary devices when setting the engine's idle speed. Such systems therefore result in increased noise and exhaust emissions as well as increased fuel consumption.

Therefore, it would be desirable to design a method and system that adaptively sets the idle speed of an internal combustion engine based on instantaneous power requirements of the engine electronics as well as system electronics when the engine is at idle.

BRIEF DESCRIPTION OF INVENTION

The present invention provides a system and method of adaptively setting the idle speed of an internal combustion engine based on instantaneous power requirements of the battery, engine electronics, and system requirements that overcome the aforementioned drawbacks. By adaptively setting the engine idle speed based on instantaneous power requirements, the noise and exhaust emissions of the engine may be reduced, while improving fuel consumption efficiency. Additionally, in the example of a boat, reducing the engine idle speed of the engine allows better low-speed trolling of the boat.

The engine's electronic control unit (ECU) is designed to regulate an idle speed controller based on current feedback received from sensors operationally connected to the engine's electronics as well as the various auxiliary devices that, in the example of a boat, would include such auxiliary devices as lights, live well aerators, bilge pumps, and the like. The ECU regulates the idle speed controller such that the engine electronics are sufficiently energized to run the engine, but the engine idle speed is also set to a level that takes into account the instantaneous power requirements of the various system components and/or devices. In this regard, the ECU is designed to access a predefined curve or map, such as a look-up table, to determine the appropriate engine idle speed based on the instantaneous power requirements or other value indicative of instantaneous power requirements of the engine electronics and system auxiliary devices.

Therefore, in accordance with one aspect of the present invention, a method of optimizing idle speed for an engine includes the steps of determining instantaneous current requirements of a watercraft and, from the instantaneous current requirements, determining a minimum engine speed necessary to continue smooth operation of the engine. The method further includes the step of adjusting, on-the-fly, idle speed of the engine to the minimum engine speed.

In accordance with another aspect of the present invention, an outboard motor includes an internal combustion engine and an alternator driven by the engine and connected to charge a battery configured to supply power. The motor includes an idle speed controller connected to the engine and configured to adaptively set an idle speed of the engine. An ECU is configured to instruct the idle speed controller to set an idle speed of the engine based on instantaneous power requirements on the battery.

According to another aspect of the present invention, a computer readable storage medium having stored thereon a computer program to adaptively regulate engine idle speed is provided. The computer program represents a set of instructions that when executed by a processor causes the processor to determine an instantaneous battery voltage level of a battery configured to supply power to the engine. The processor is further caused to determine instantaneous power requirements of the engine, and based on the instantaneous battery voltage level and the instantaneous power requirements, determine an engine idle speed.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

The present invention will be described with respect to an adaptive idle speed control for a direct injected internal combustion engine of an outboard motor used to propel a boat. However, the present invention is equivalently applicable with inboard engines as well as engines used to power other types of recreational products, such as PWCs, snowmobiles, and ATVs.

Figure 1:
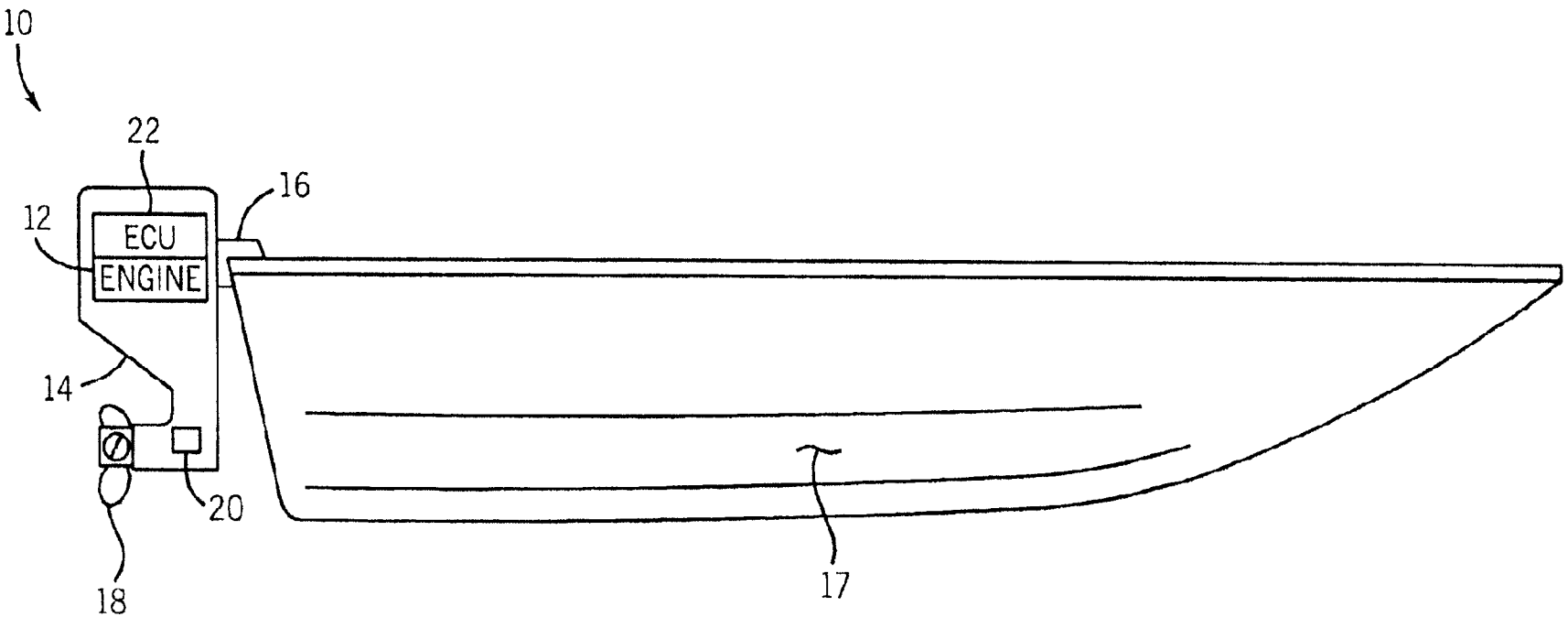
FIG. 1 is a schematic view of an outboard motor mounted to a boat incorporating the present invention.

Referring to FIG. 1, a schematic view of an outboard motor 10 includes an internal combustion engine 12 housed in a power head 14 and supported on a mid-section 16 configured for mounting to a boat 17 in a conventional manner. The output shaft (not shown) of the motor 10 is coupled to a propeller 18 extending rearwardly from a lower gear case 20 attached to the lower end of the midsection 16. The internal combustion engine 12 may be controlled by an electronic control unit (ECU) 22, which, in a preferred embodiment, has an integral computer programmed in accordance with the present invention.

Figure 2:
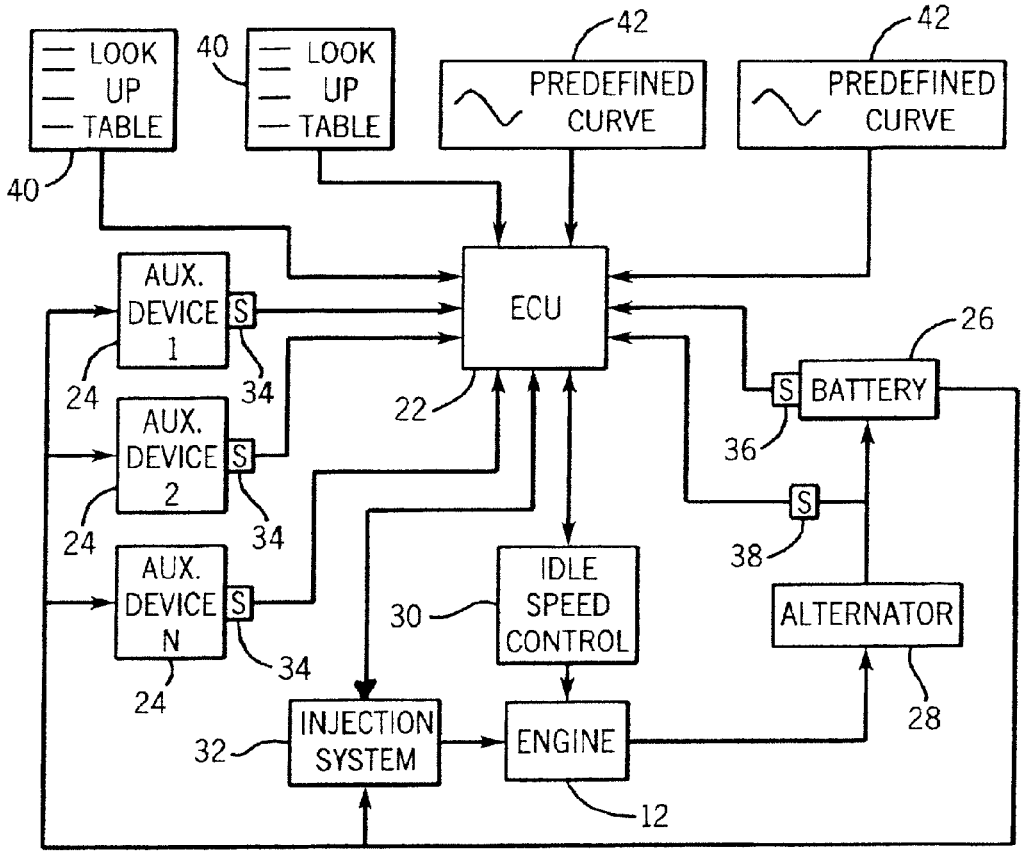
FIG. 2 is a block diagram of an ECU controlled engine and auxiliary electronics system in accordance with the present invention.

FIG. 2, is a block diagram of an ECU controlled engine and an auxiliary electronics system in accordance with one aspect of the present invention. ECU 22 is designed to regulate operation of engine 12 as well as a number of auxiliary devices 24. The auxiliary devices may include bilge pumps, lights, live well aerators, and the like. The auxiliary devices are powered by a battery 26. Battery 26 is connected to alternator 28 or other battery charging device in such a manner as to allow alternator 28 to recharge the battery so that the battery maintains a sufficient charge level. During use or over time, the charge level of the battery may decrease, but alternator 28 is designed to recharge the battery 26 to an appropriate level.

Engine 12, in one embodiment, includes a direct fuel injected engine for an outboard motor. In this regard, the idle speed of engine 12 is typically set such that the current output of alternator 28 is sufficient to charge battery 26 to a voltage level sufficient to power the engine electronics as well as the various auxiliary devices 24 and supply sufficient current to the fuel injectors. ECU 22 is therefore connected to an idle speed controller 30 to set the idle speed of engine 12. As will be described in greater detail below, ECU 22 transmits command signals to idle speed controller 30 so as to adaptively regulate the idle speed of engine 12 based on at least the instantaneous power requirements of the auxiliary devices 24. In a further embodiment, ECU 22 further takes into account the instantaneous charge level of battery 26 when determining the appropriate engine idle speed.

Still referring to FIG. 2, ECU 22 is designed to adaptively regulate the idle speed of engine 12 based on instantaneous power requirements. Such instantaneous power requirements can include that required by engine electronics such as ignition system 32 as well as various auxiliary devices 24. It is understood that the term instantaneous is generally referring to real-time sampling, but includes generally recognized, reasonable delays that may occur in real-time sampling. Each auxiliary device is operationally connected to a sensor 34 that provides feedback to ECU 22 regarding the instantaneous power requirements of each respective auxiliary device 24. In a further embodiment, battery 26 is operationally connected to a voltage sensor 36 that provides voltage feedback to the ECU 22 regarding the instantaneous charge level of the battery. ECU 22 is also connected to a sensor 38 designed to provide feedback to ECU 22 regarding current output of alternator 28. ECU 22 is configured to compare the feedback received from the exemplary sensors 34–38 to data stored in a look-up table 40 and/or a predefined curve 42. There may be one or more such tables and/or curves that are based on different criteria. From the comparison, ECU 22 can determine an idle speed that minimally drives alternator 28 to charge battery 26 to provide sufficient power for the engine electronics as well as auxiliary devices 24. In this regard, ECU 22 may compare the battery voltage level from sensor 36 to look-up table 40 and/or predefined curve 42, and/or the alternator output current from sensor 38 to determine the appropriate idle speed. Once the appropriate idle speed is determined, ECU 22 commands idle speed controller 30 to set the idle speed of engine 12 to the determined level.

In a further embodiment, ECU 22 may be configured to control the idle speed of engine 12 such that the charge level of the battery does not fall below a certain level. In yet a further embodiment, ECU 22 may be configured to set the idle speed such that the alternator output current 38 does not fall below a minimum level. In this regard, ECU 22 may set the idle speed without reliance upon any look-up tables 40 or predefined curves 42. However, it is currently preferred that look-up tables 40 and/or predefined curves 42 be implemented as each may be constructed to contain data setting forth the appropriate engine idle speed as a function of instantaneous power requirements and battery voltage level and/or alternator current output level. Additionally, for certain conditions, such as engine warm-up, the idle speed may be adjusted to a preset value for that particular condition, independent of the instantaneous power requirements of the auxiliary devices and/or engine electronics.

Figure 3:
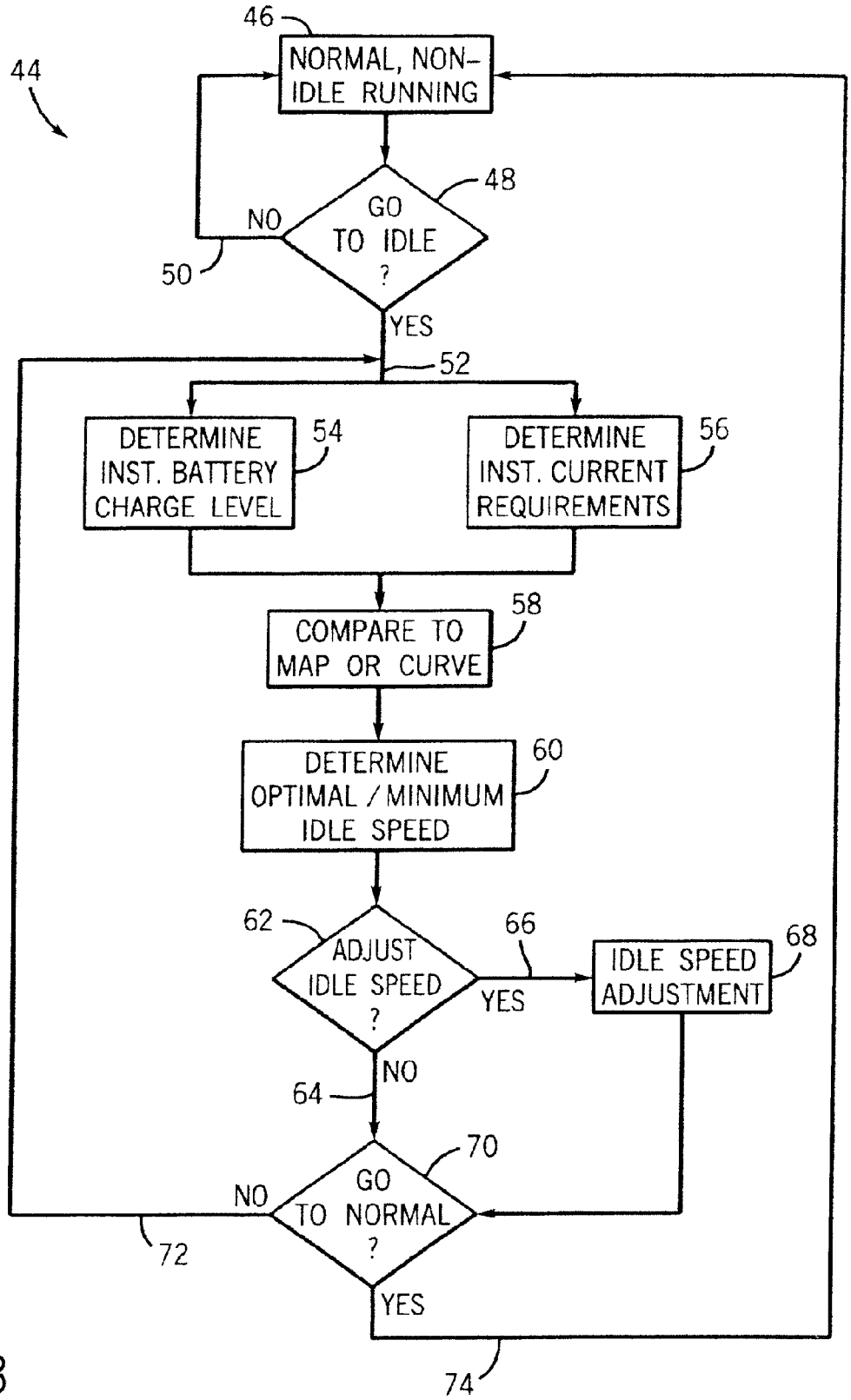
FIG. 3 is a flow chart setting forth the steps of an adaptive idle speed control in accordance with the present invention.

Referring now to FIG. 3, a flow chart 44 setting forth the acts/steps of an adaptive idle speed control/process for a direct injected internal combustion engine is shown. The adaptive speed control process 44 begins at 46 with the engine running in a normal, non-idle mode. Process 44, which may be carried out as part of a computer program executed by a processor in the ECU, determines if a go-to-idle command 48 has been transmitted to the ECU. If not 50, normal, non-idle running of the engine is maintained. If so 48, 52, process 44 then determines, ideally, both battery charge level 54 as well as instantaneous power or current requirements 56 of the engine electronics as well as the auxiliary devices. As noted above, process 44, however, may be implemented such that the instantaneous battery charge level of the motor's battery is not required in determining the appropriate engine idle speed.

Once the battery charge level 54 and the instantaneous power requirements of the engine electronics and system auxiliary devices 56 have been determined, process 44 continues to step 58 wherein the instantaneous power requirements at the particular battery charge level are compared to a predefined map or curve. From this comparison, process 44 determines a minimum or optimal engine idle speed necessary to drive the alternator to meet the instantaneous power requirements of the system at the instantaneous battery charge level 60. From this determination, process 44 compares the minimal idle speed with the current idle speed at 62 to determine if an adjustment is necessary. If not 62, 64, process 44 returns to determine the instantaneous battery charge level as well as instantaneous power or current requirements of the system in steps 54 and 56. If yes 62, 66, the idle speed controller is controlled to adjust or set the engine idle speed at 68 to the speed determined at step 60.

After the engine idle speed has been adjusted at step 68, or if no adjustment is made at step 64, process 44 determines if a go-to-normal, non-idle running command has been received at 70. If not 70, 72, the process returns to steps 52 and 54 to determine the instantaneous battery charge level and instantaneous power or current requirements of the system electronics whereupon steps 54–68 are re-processed. If a go-to-normal command has been received 70, 74, process 44 returns the engine to normal, non-idle running at step 46. Further, while the steps of process 44 show a determination as to whether a go-to-normal or non-idle running is processed after an idle speed adjustment has been determined, the engine may be commanded to a normal or non-idle running at any time during the processing of steps 52–68. In this regard, the engine may be placed at idle for a brief period and returned to normal operation before the idle speed adjustment process has been carried out.

Figure 4:
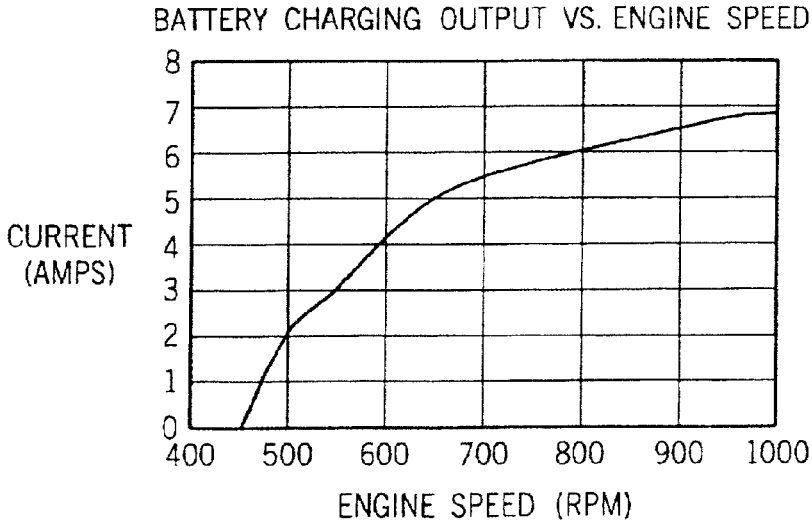
FIG. 4 is a graph illustrating one example of a predefined curve of battery charging output as a function of engine speed in accordance with one aspect of the present invention.

Referring now to FIG. 4, one example of a curve which may be accessed by the ECU to determine the appropriate engine idle speed as a function of alternator current output is shown. As illustrated, as engine speed decreases, the alternator current output also decreases. For example, at an engine speed of 500 RPM, the alternator current output is approximately 2 amperes (A). As such, if 2 A are sufficient to properly power the engine electronics as well as the activated auxiliary devices then the idle speed can safely be set at approximately 500 RPM. While 2 A may be sufficient to properly power the engine electronics and the system electronics or auxiliary devices under all conditions, at a particular instant or condition, 2 A may be more than is needed. In this regard, the engine idle speed may be reduced below 500 RPM to allow the alternator to output current at less than 2 A. As such, the fuel consumption and exhaust emissions are reduced, as well as noise emissions. One skilled in the art will readily appreciate that the curve illustrated in FIG. 4 is just one example of a predefined curve that may be used to adaptively set the engine idle speed. As such, the present invention contemplates other shaped curves that would produce different target engine speeds as a function of alternator current output. Further, the present invention contemplates predefined maps, look-up tables, or other curves that may be developed and accessed to determine optimal idle engine speed as a function of other operating parameters such as battery voltage. Additionally, the present invention contemplates reducing engine idle speed below 450 RPM, and is only limited by the engine requirements, not charging requirements. For instance, when the battery is fully charged and few, if any, auxiliary devices are being used, the engine idle speed could be lowered to a level less than 450 RPM.

Therefore, in accordance with one embodiment of the present invention, a method of optimizing idle speed for a direct fuel injected engine includes the steps of determining instantaneous current requirements of electronics of a watercraft and, from the instantaneous current requirements, determining a minimum engine speed necessary to drive a battery charging device of the watercraft. The method further includes the step of adjusting, on-the-fly, idle speed of the direct fuel injected engine to the minimum engine speed.

In accordance with another embodiment of the present invention, an outboard motor includes a direct injected internal combustion engine and an alternator driven by the engine and connected to charge a battery configured to supply power. The motor includes an idle speed controller connected to the engine and configured to adaptively set an idle speed of the engine. An ECU is configured to instruct the idle speed controller to set an idle speed of the engine based on instantaneous power requirements of a plurality of auxiliary devices powered by the battery.

According to another embodiment of the present invention, a computer readable storage medium having stored thereon a computer program to adaptively regulate engine idle speed is provided. The computer program represents a set of instructions that when executed by a processor causes the processor to determine an instantaneous battery voltage level of a battery configured to supply power to a plurality of auxiliary devices. The processor is further caused to determine instantaneous power requirements of the plurality of auxiliary devices and based on the instantaneous battery voltage level and the instantaneous power requirements, determine an engine idle speed.

The present invention has been described in terms of the preferred embodiment, and it is recognized that equivalents, alternatives, and modifications, aside from those expressly stated, are possible and within the scope of the appending claims.

What is claimed is:

1. A method of optimizing idle speed for a fuel injected engine comprising the steps of:

determining instantaneous current requirements of electronics of a watercraft;

from the instantaneous current requirements, determining a minimum engine speed necessary to drive a battery charging device of the watercraft; and adjusting, on-the-fly, idle speed of the fuel injected engine to the minimum engine speed.

2. The method of claim 1 wherein the step of determining instantaneous current requirements of electronics of the watercraft at idle further includes the step of acquiring current feedback data from a plural of current sensors operationally connected to the electronics.

3. The method of claim 1 further comprising the step of determining a charge level of a battery of the watercraft.

4. The method of claim 3 wherein the step of determining a minimum engine speed includes the step of isolating an engine speed sufficient to drive the battery charging device to charge the battery given the instantaneous current requirements of the electronics and the battery charge level.

5. The method of claim 4 further comprising the step of comparing the instantaneous current requirements of the electronics and charging output of the battery charging device with a predetermined map of data to determine the minimum engine speed.

6. The method of claim 1 further comprising the step of adjusting the idle speed to a level sufficient to drive the battery charging device such that a charge level of a battery of the watercraft remains above a predetermined charge level.

7. The method of claim 1 wherein the electronics include at least one of an ECU, lights, live well aerators, pumps, fuel injectors and alternator.

8. An outboard motor comprising:

an Internal combustion engine;

an alternator driven by the engine and connected to charge a battery;

an idle speed controller connected to the engine and configured to adaptively set an idle speed of the engine; and an ECU to instruct the idle speed controller to set an idle speed of the engine based on instantaneous power requirements on the battery.

9. The outboard motor of claim 8 further comprising a plurality of current sensors connected to provide feedback to the ECU of instantaneous current requirements of a plurality of auxiliary devices.

10. The outboard motor of claim 8 wherein the ECU further includes memory having stored therein a predefined curve representing alternator output versus idle engine speed data.

11. The outboard motor of claim 10 wherein the ECU is further configured to determine idle speed from the predefined curve based on the instantaneous power requirements.

12. The outboard motor of claim 8 wherein the ECU is further configured to determine idle speed to prevent voltage of the battery from falling below a predetermined level.

13. The outboard motor of claim 8 wherein the ECU is further configured to determine an idle speed for warm-up conditions of the engine that is independent of the instantaneous power requirements.

14. The outboard motor of claim 8 wherein the ECU is further configured to instruct the idle speed control to set the idle speed of the engine to a level minimally sufficient to run the engine and satisfy the instantaneous power requirements.

15. The outboard motor of claim 8 wherein the internal combustion engine has at least one fuel injector in direct communication with a cylinder of the internal combustion engine.

16. A computer readable storage medium having stored thereon a computer program to adaptively regulate engine idle speed, the computer program having a set of instructions that when executed by a processor cause the processor to:

determine an instantaneous battery voltage level of a battery configured to supply power to an engine;

determine instantaneous power requirements of the engine; and based on the instantaneous battery voltage level and the instantaneous power requirements, determine an engine idle speed.

17. The computer readable storage medium of claim 16 wherein the set of instructions further causes the processor to determine the engine idle speed from a map of predefined values stored in a memory accessible by the computer.

18. The computer readable storage medium of claim 15 wherein the set of instructions further causes the processor to set engine idle speed to a level sufficient to drive a battery charging device such that the instantaneous battery voltage remains above a predetermined level.

19. The computer readable storage medium of claim 18 wherein the set of instructions further causes the processor to set the idle speed to below 500 RPM.

20. The computer readable storage medium of claim 16 wherein the set of instructions further causes the processor to set idle speed to a speed lower than that needed when the battery is not fully charged and the instantaneous power requirements of the engine is below a predetermined level.

21. The computer readable storage medium of claim 16 incorporated in an ECU of an outboard motor having a direct injected engine.

* * * * *